US010513005B2

(12) United States Patent
Kawakami et al.

(10) Patent No.: US 10,513,005 B2
(45) Date of Patent: Dec. 24, 2019

(54) POWER TOOL

(71) Applicant: MAKITA CORPORATION, Anjo-Shi (JP)

(72) Inventors: Takahiro Kawakami, Anjo (JP); Yoshinori Sasaki, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 167 days.

(21) Appl. No.: 15/785,705

(22) Filed: Oct. 17, 2017

(65) Prior Publication Data

US 2018/0117728 A1 May 3, 2018

(30) Foreign Application Priority Data

Nov. 2, 2016 (JP) ..... 2016-215421
Apr. 11, 2017 (JP) ..... 2017-078387

(51) Int. Cl.

| | |
|---|---|
| ***B24B 23/02*** | (2006.01) |
| ***B24B 47/12*** | (2006.01) |
| ***B25F 5/02*** | (2006.01) |
| ***B25F 5/00*** | (2006.01) |

(52) U.S. Cl.

CPC ..... *B24B 23/02* (2013.01); *B24B 23/028* (2013.01); *B24B 47/12* (2013.01); *B25F 5/008* (2013.01); *B25F 5/02* (2013.01); *B25F 5/026* (2013.01)

(58) Field of Classification Search

CPC ..... B24B 23/02; B24B 23/028; B24B 23/03; B24B 23/04; B24B 47/12; B25F 5/008; B25F 5/02; B25F 5/026; H01M 2/1022; H01M 2/1027

See application file for complete search history.

(56) References Cited

U.S. PATENT DOCUMENTS

| | | | | |
|---|---|---|---|---|
| 5,028,858 | A | 7/1991 | Schnizler et al. | |
| 5,553,675 | A * | 9/1996 | Pitzen | A61B 17/1628 173/217 |
| 6,120,362 | A * | 9/2000 | Etter | B25F 5/02 451/354 |
| 6,577,104 | B2 * | 6/2003 | Sakakibara | H02J 7/0031 320/132 |
| 6,632,128 | B2 * | 10/2003 | Berger | B24B 23/028 451/344 |

(Continued)

FOREIGN PATENT DOCUMENTS

| | | |
|---|---|---|
| GB | 2226716 A | 7/1990 |
| JP | 2015174214 | 10/2015 |

OTHER PUBLICATIONS

Un-published U.S. Appl. No. 15/724,503.
Un-published U.S. Appl. No. 15/724,598.

*Primary Examiner* — Timothy V Eley
(74) *Attorney, Agent, or Firm* — J-TEK Law PLLC; Jeffrey D. Tekanic; Scott T. Wakeman

(57) ABSTRACT

A power tool, such as a grinder, includes a motor housing that houses a motor. A grip housing extends in a longitudinal direction of the power tool and has a first longitudinal end coupled to the motor housing, first and second battery-mount parts formed at a second longitudinal end, and a grip part disposed between the first and second longitudinal ends. First and second battery packs are respectively mountable on the first and second battery-mount parts, and the grip housing comprises an upper housing half joined to a lower housing half.

20 Claims, 11 Drawing Sheets

(56) References Cited

U.S. PATENT DOCUMENTS

| | | | | |
|---|---|---|---|---|
| 7,176,656 | B2 | 2/2007 | Feldmann | |
| 7,270,910 | B2 * | 9/2007 | Yahnker | B25F 5/008 30/500 |
| 8,984,711 | B2 * | 3/2015 | Ota | H01M 2/10 15/339 |
| 9,630,310 | B2 * | 4/2017 | Ito | H02J 7/00 |
| 9,954,418 | B2 * | 4/2018 | Kawakami | H02K 9/06 |
| 2003/0102844 | A1 * | 6/2003 | Bailey | B25F 5/00 320/114 |
| 2005/0280393 | A1 | 12/2005 | Feldmann | |
| 2006/0077603 | A1 | 4/2006 | Kim | |
| 2008/0203995 | A1 | 8/2008 | Carrier et al. | |
| 2010/0009608 | A1 * | 1/2010 | Lo | B24B 23/028 451/357 |
| 2011/0147031 | A1 | 6/2011 | Matthias et al. | |
| 2011/0197389 | A1 | 8/2011 | Ota et al. | |
| 2011/0198103 | A1 | 8/2011 | Suzuki | |
| 2012/0037385 | A1 * | 2/2012 | Suzuki | B25F 5/02 173/2 |
| 2012/0165152 | A1 * | 6/2012 | Tokunaga | B23D 47/12 475/159 |
| 2015/0263592 | A1 | 9/2015 | Kawakami et al. | |
| 2017/0110946 | A1 * | 4/2017 | Oktavec | H02K 11/33 |
| 2018/0304454 | A1 * | 10/2018 | Kawakami | B25F 5/02 |

* cited by examiner

POWER TOOL

CROSS-REFERENCE

The present application claims priority to Japanese patent application serial numbers 2016-215421 filed on Nov. 2, 2016 and 2017-078387 filed on Apr. 11, 2017, the contents of both of which are incorporated fully herein by reference.

TECHNICAL FIELD

The present invention relates to a power tool such as a rechargeable grinder.

BACKGROUND ART

In some power tools, such as the rechargeable grinders disclosed in Japanese Laid-open Patent Publication 2015-174214 and US 2015/0263592, a grip part is formed on a housing, a battery pack is mounted on a battery-mount part, which is provided rearward of the grip part, and drive power is supplied by the battery pack. This housing comprises a pair of half housing mating parts (housing halves), which have been divided in the left and right direction and are assembled (joined) to one another by screws that are inserted and extend in the left-right direction.

SUMMARY

To enable, e.g., continuous use over a longer period of time, power tools have been developed in recent years that have two battery-mount parts on the housing for two battery packs to be respectively mounted thereon, so that the energy from both battery packs may be simultaneously used to operate the power tool, thereby increasing the power capacity and/or power output of the power tool. In such power tools, if the housing having the battery-mount parts is formed as a left-right divided structure, then it is necessary to provide an intermediate structure between the left and right half housings, which intermediate structure forms a part between the left and right battery-mount parts, in order to dispose the two battery-mount parts side-by-side in the left-right direction. Thereby, the mold structure for forming the left and right half housings becomes complex and, moreover, the part count also increases, which leads to an increase in cost. In addition, when electrical components are installed, assembly becomes very difficult.

Accordingly, in one aspect of the present teachings, a power tool has two battery-mount parts disposed side-by-side in the left-right direction of the power tool. The housing can be manufactured at a relatively low cost and without a complicated housing shape.

In another aspect of the present teachings, a power tool includes: a motor housing that houses a motor; a grip housing coupled to the motor housing in the front-rear direction and having a grip part; and battery-mount parts formed on the grip housing and on which battery packs is mountable. The grip housing is formed by assembling (joining) two housing halves, which are divided in the up-down direction of the power tool.

In another aspect of the present teachings, the housing halves, which are divided in the up-down direction, may be assembled by inserting, and then fastening, one or more screws from a first one of the housing halves, either an upper housing half or a lower housing half, into a second one of the housing halves.

In another aspect of the present teachings, a switch for driving the motor is housed inside the grip housing, and a switch lever for manipulating the switch ON and OFF is provided on the first one of the housings.

In another aspect of the present teachings, a controller for controlling the motor is housed inside the grip housing, and a holding part that holds the controller is provided in the second one of the housings.

In another aspect of the present teachings, a power tool includes: a motor; a head part disposed on a front side of the motor; a grip part disposed on a rear side of the motor and comprising a switch lever; and a battery-mount part disposed on a rear side of the grip part and on which a battery pack is mountable. When the battery pack is mounted on the battery-pack mount part, the overall center of gravity of the power tool is located within a range that extends 30 mm forward of a front end of the switch lever to 30 mm rearward of the front end of the switch lever.

In another aspect of the present teachings, the overall center of gravity of the power tool is set to a location that is the same as the front end of the switch lever in the up-down direction of the power tool.

In another aspect of the present teachings, the power tool has two battery-mount parts disposed on the rear side of the grip part and two battery packs are respectively mounted on the two battery-mount parts. In such an embodiment, the overall center of gravity of the power tool is preferably set to a location 15 mm forward of the front end of the switch lever.

In another aspect of the present teachings if the grip housing is formed by assembling (joining) the two housing halves, which are divided in the up-down direction of the power tool, the two battery-mount parts can be disposed side-by-side in the left-right direction while simplifying assembly and without complicating the mold shape for forming the grip housing.

In another aspect of the present teachings, if the housing halves, which are divided in the up-down direction, are assembled by screwing one or more screws from a first one of the housings into a second one of the housings, the upper and lower housings can be assembled easily.

In another aspect of the present teachings, if the switch lever for manipulating the switch ON and OFF is provided on the first one of the housings, the switch lever can be easily assembled in the first one of the housings, which becomes the upper side at the time of assembly.

In another aspect of the present teachings, if the holding part that holds the controller is provided in the second one of the housings, the controller can be easily assembled in the second one of the housings, which becomes the lower side at the time of assembly.

Additional objects, features, embodiments and advantages of the present teachings will become apparent upon reading the following detailed description in view of the appended claims and attached drawings.

BRIEF DESCRIPTION OF THE DRAWINGS

FIGS. 6A and 6B are explanatory diagrams of a vibration-isolating rubber ring, in which FIG. 6A is an oblique view viewed from the front and FIG. 6B is an oblique view viewed from the rear.

FIGS. 7A-7F are explanatory diagrams of the vibration-isolating rubber ring, in which FIG. 7A is a front view, FIG. 7B is a rear view, FIG. 7C is a top view, FIG. 7D is a bottom view, FIG. 7E is a side view, and FIG. 7F is a center cross-sectional view.

DETAILED DESCRIPTION OF EMBODIMENTS

Figure 1:
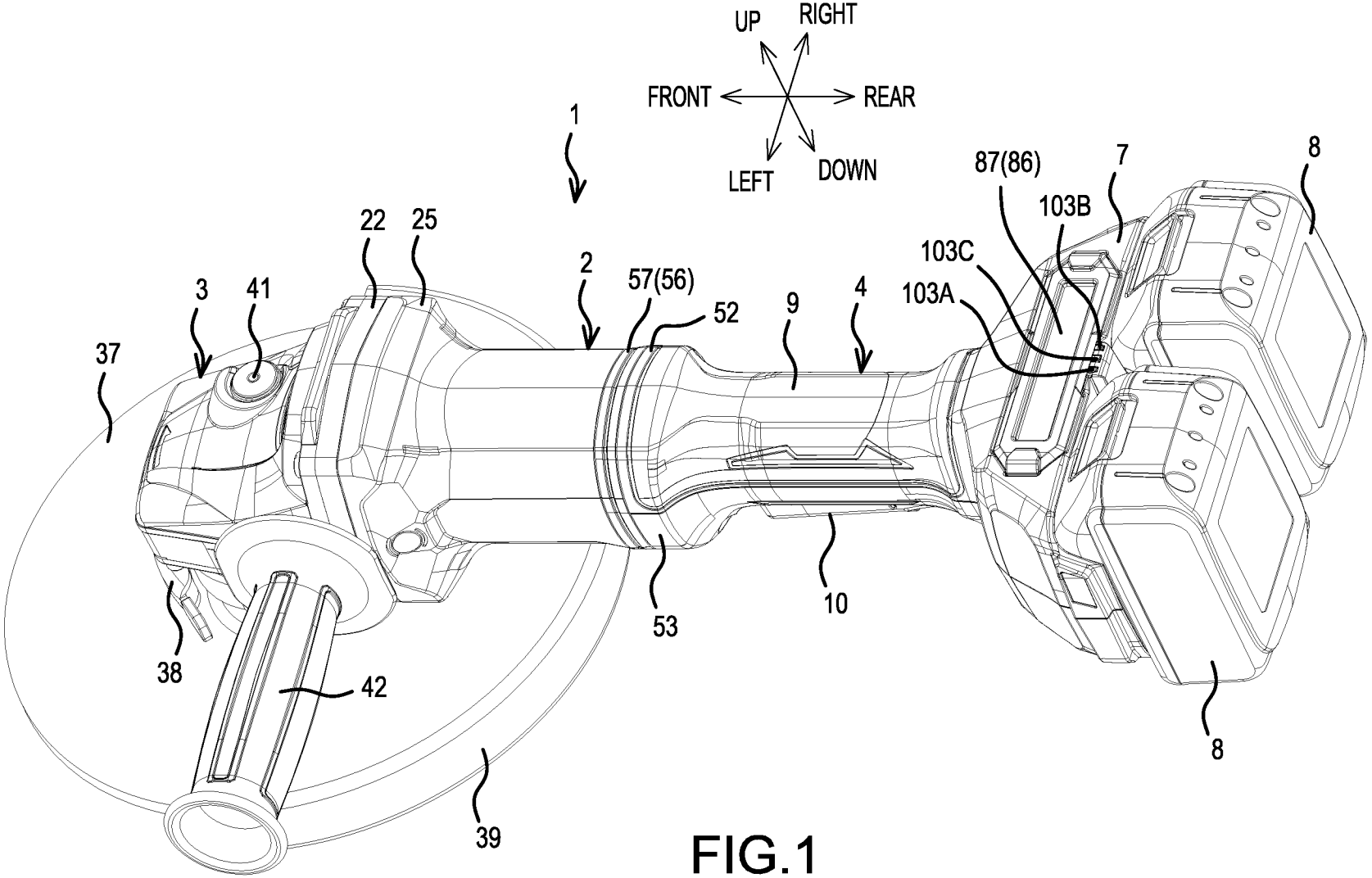
FIG. 1 is an oblique view of a rechargeable grinder according to one representative, non-limiting embodiment the present invention.

Embodiments of the present invention are explained below, with reference to the drawings.

Referring to FIGS. 1-4, a housing of a rechargeable grinder 1 (hereinbelow, simply called "grinder") according to the present teachings comprises: a motor housing 2; a gear housing 3, which is coupled to a front side of the motor housing 2 and serves as a head part; and a grip housing 4, which is coupled to a rear side of the motor housing 2. A brushless motor 5 is housed inside the motor housing 2, and a spindle 6 that rotates when driven by the brushless motor 5 protrudes downward from the gear housing 3. A flared part 7 is formed on a rear end of the grip housing 4, and flares in the left-right direction as it goes in the rearward direction. Two (left and right) battery packs 8 (e.g., battery packs having an 18-V rated voltage) are mountable thereon. In addition, a grip part 9 is formed on an intermediate part of the grip housing 4, and a switch lever (paddle switch) 10 is provided on a lower side thereof.

Figure 5:
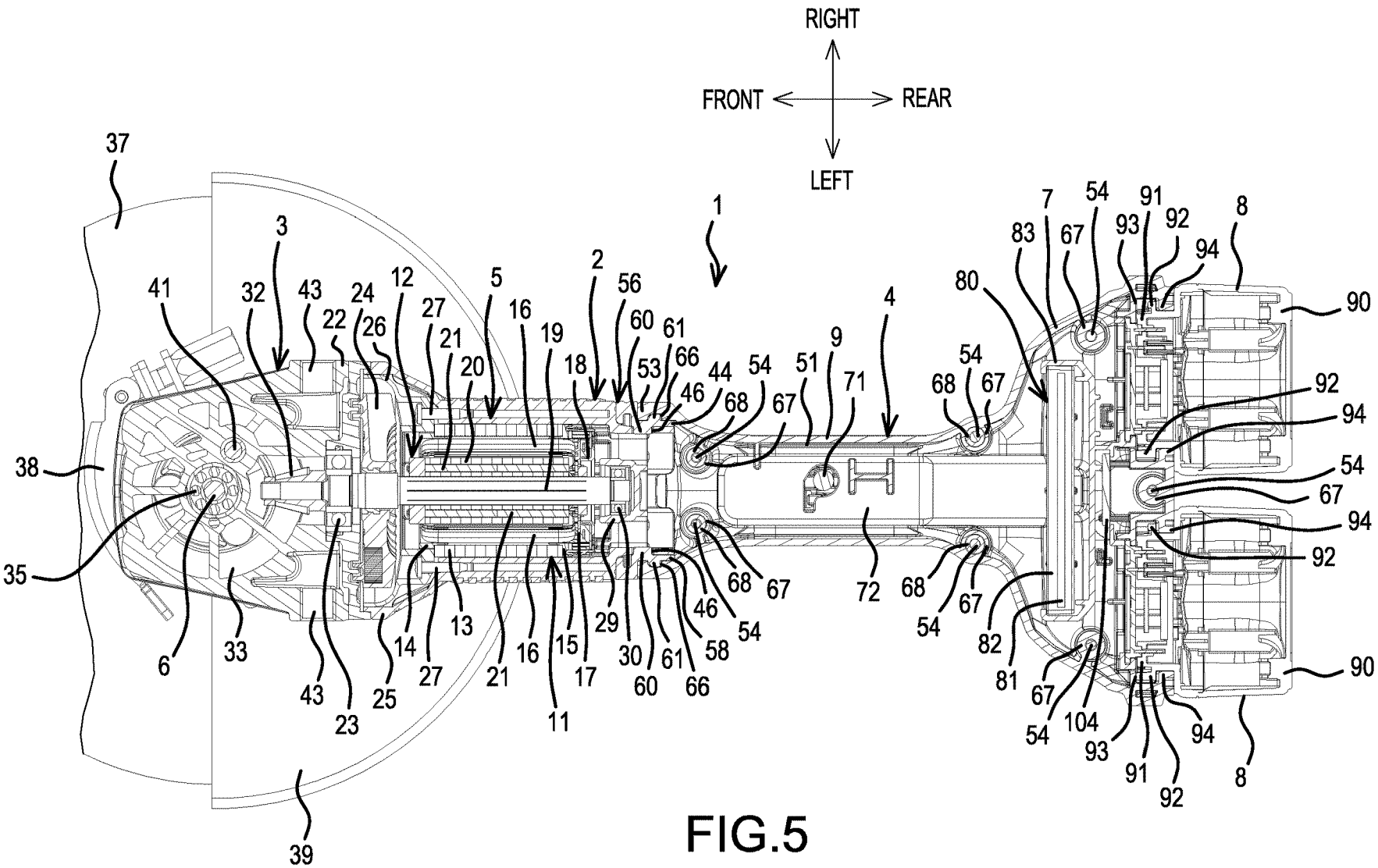
FIG. 5 is a cross-sectional view taken along line A-A in FIG. 4.

The motor housing 2 is formed in a tubular shape and coaxially holds the brushless motor 5 in a frontward facing manner. As also shown in FIG. 5, the brushless motor 5 is an inner-rotor-type motor that comprises a stator 11 and, in the interior thereof, a rotor 12. The stator 11 comprises a tubular stator core 13, which is formed of a plurality of laminated steel sheets, a front insulator 14 and a rear insulator 15, which are respectively provided on the front and rear end surfaces of the stator core 13 in the axial direction, and six coils 16, which are wound on the stator core 13 and through the front and rear insulators 14, 15. A sensor circuit board 17 and a short-circuiting member 18 are attached to the rear insulator 15.

The sensor circuit board 17 is doughnut-shaped and three rotation-detection devices (not shown), which detect the positions of permanent magnets 21 provided on the rotor 12 and output rotation-detection signals, are installed thereon. By superimposing the short-circuiting member 18 on the rearward side of the sensor circuit board 17 and fixing it thereto with screws, fusing terminals, which are provided on the rear insulator 15 and are fused to wires between the coils 16 are electrically connected, thereby completing the wiring connections.

The rotor 12 comprises a rotary shaft 19 located along the axial center of the rotor 12, a substantially circular-cylindrical rotor core 20 disposed around the rotary shaft 19 and formed by stacking a plurality of steel plates, and four plate-shaped permanent magnets 21 fixed to an inner part of the rotor core 20.

The front portion of the rotary shaft 19 is axially supported by a first bearing 23 held by a partition plate 22 interposed between the motor housing 2 and the gear housing 3; the tip of the rotary shaft 19 protrudes into the gear housing 3. Rearward of the partition plate 22, a centrifugal fan 24 is attached to the rotary shaft 19, a front end of the motor housing 2, in which the centrifugal fan 24 is housed, is a tapered part 25 that flares forward, and a baffle plate 26 that guides forward an airflow, which is produced by the centrifugal fan 24 in a radial direction, is provided inside the tapered part 25.

The baffle plate 26 is fixed to the motor housing 2 by screws 27 (FIG. 5) from the front. The stator core 13 of the stator 11 is fixed at the same time by being sandwiched between the baffle plate 26, which has been fastened by the screws, and a support step part 28 (FIG. 4), which is formed on a rear part of the motor housing 2. A through hole (not shown) is provided in the partition plate 22, which enables the airflow from the centrifugal fan 24 to be delivered into the gear housing 3. A rear portion of the rotary shaft 19 is axially supported by a second bearing 30 inside a holding part 29, which is supported inside a rear end of the motor housing 2.

The gear housing 3 is fixed by screwing four screws 31, which are inserted from the front at four corners in a front view, into the tapered part 25 of the motor housing 2 through the partition plate 22. A bevel gear 32 is fastened to a front end of the rotary shaft 19, which protrudes into the gear housing 3, and meshes with a bevel gear 33 fastened to an upper end of the spindle 6. The spindle 6 is axially supported by upper and lower bearings 35, 36, which are held by the gear housing 3 and a bearing box 34 that is assembled (mounted) onto a lower part of the gear housing 3, and protrudes downward. A tool accessory 37, such as a discoidal (disk-shaped) grinding wheel, can be mounted on a lower end of the spindle 6. A wheel cover 39 that covers a rear-half part of the tool accessory 37 is mounted, by tightening a belt-shaped clamp 38, on an outer circumference of the bearing box 34. Air-exhaust ports 40 are formed in a front surface of the gear housing 3. A shaft lock 41 engages with the bevel gear 33 when pushed in and is capable of locking the rotation of the spindle 6. Screw holes 43, into which a side handle 42 is screwed and thereby mounted, are formed in left- and right-side surfaces of the gear housing 3.

The grip housing 4 is divided into two housing halves in the up-down direction, namely an upper housing (upper housing half) 50 and a lower housing (lower housing half) 51. The grip housing 4 is assembled by fixing the upper and lower housings 50, 51 to one another with screws 54 that extend in the up-down direction. At the time of assembly, an interior ring part 44, which is formed on a rear end of the motor housing 2 and from which stops 45 (FIGS. 4, 8) project discontinuously in the circumferential direction on a rear end outer circumference of the motor housing 2, is sandwiched from above and below by semicircular outer-side sandwich parts 52, 53, which are provided on the respective front ends of the upper and lower housings 50, 51. In the present embodiment, the mating surfaces of the upper and lower housings 50, 51 are located upward of an axis line (rotational axis) of the rotary shaft 19 inside the motor housing 2. A region (surface portion) of the grip part 9 on the upper housing 50 is covered with an elastomer 55.

A ring-shaped vibration-isolating rubber ring 56 is mounted on (around the exterior surface of) the interior ring part 44 and is interposed between the grip housing 4 and the motor housing 2 in the assembled state of the grip housing 4.

Figure 6B:
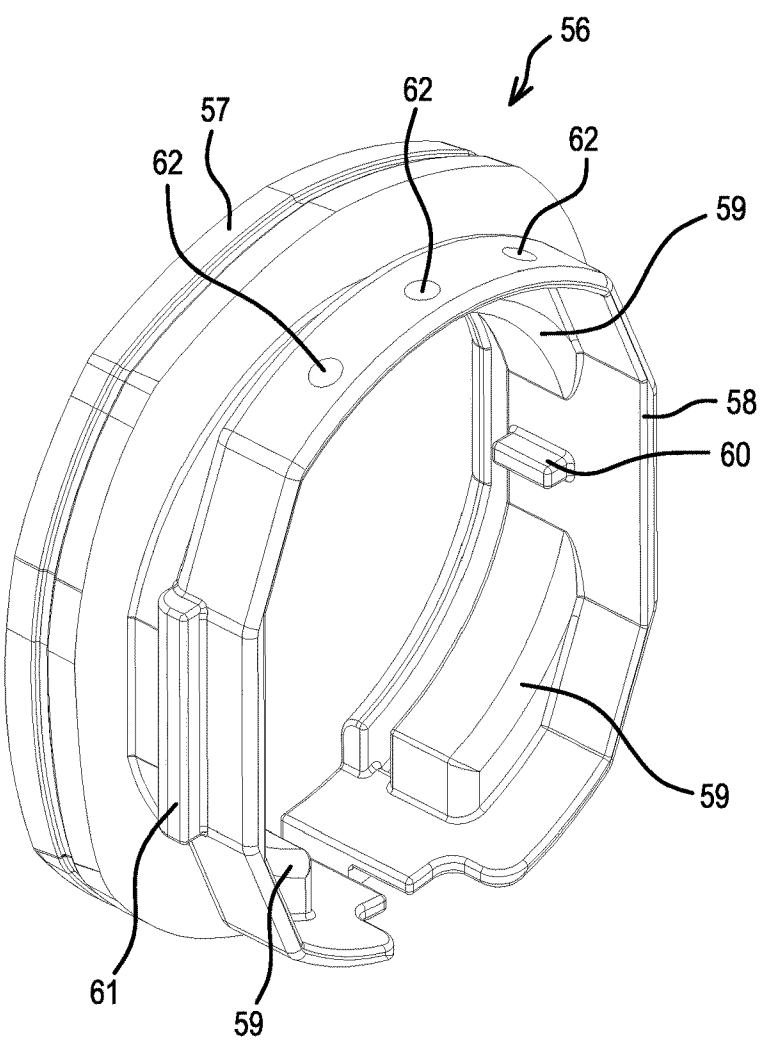
Figure 6A:
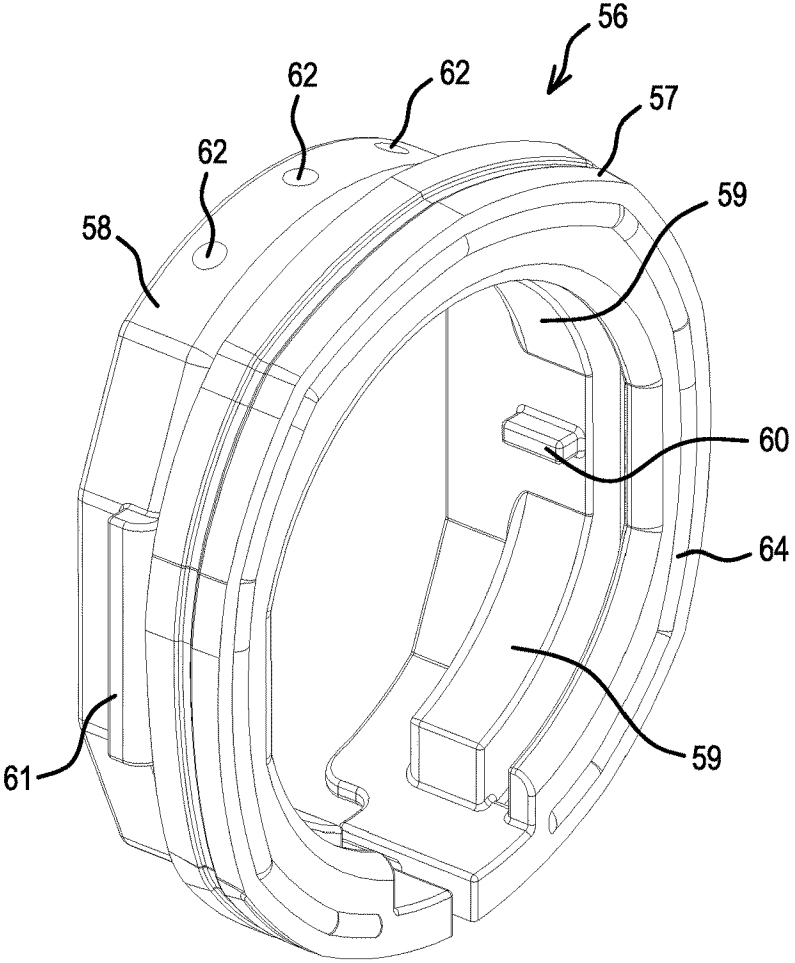
Figure 7C:
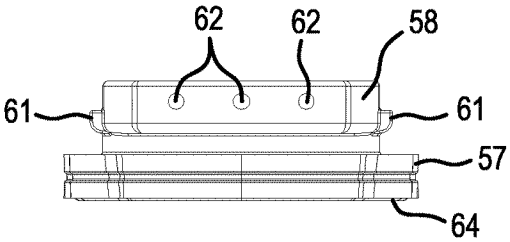
Figure 7A:
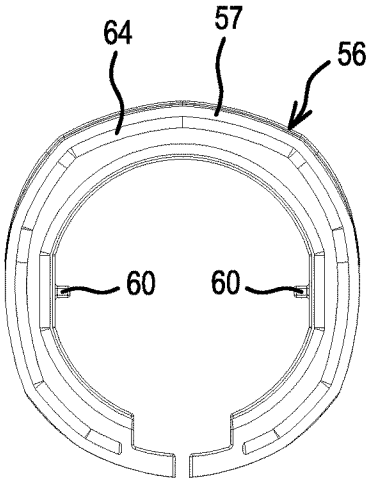
Figure 7E:
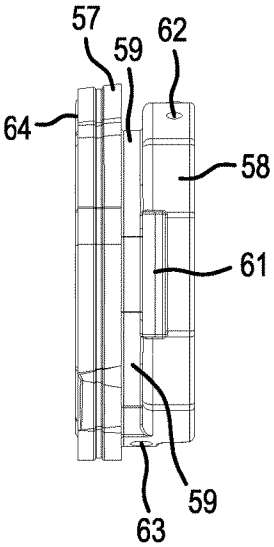
Figure 7F:
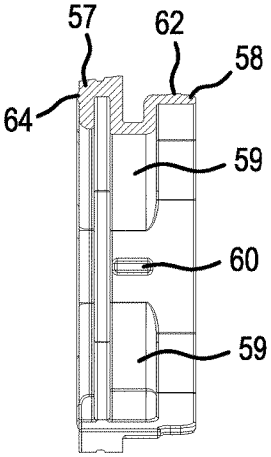
Figure 7B:
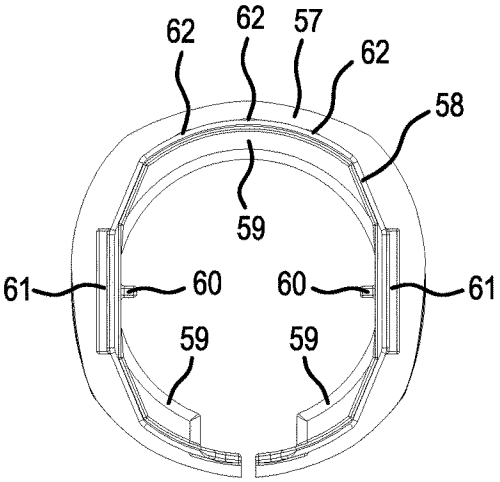
Figure 7D:
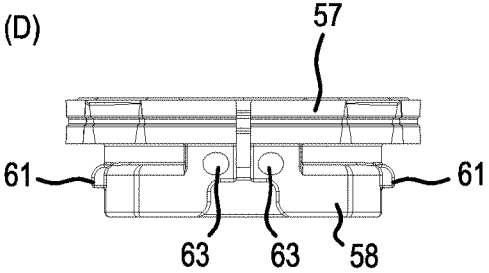

As shown in FIGS. 6 and 7, the vibration-isolating rubber ring 56 has a C shape in a front view, the lower-end center of which is divided in the axial direction. A large-diameter part 57 is formed on the front side of the vibration-isolating rubber ring 56 and has an exterior surface that coincides (extends in a flush manner) with the outer diameter (exterior surface) of the motor housing 2 at a position forward of the interior ring part 44. A small-diameter part 58 is formed rearward of the large-diameter part 57 and overlaps the outer shape (external surface) of the rearward-edge of the interior ring part 44 that includes the stops 45. At the connection (base) of the small-diameter part 58 to the large-diameter part 57, latching protruding parts 59, which are located on the front side of the stops 45 and protrude inwardly, are formed. In addition, projections 60 that extend in the front-rear direction and mate with through holes 46, which are elongated in the front-rear direction and are formed in the left and right side surfaces of the interior ring part 44 forward of the stops 45, are formed on the left and right inner surfaces between the upper and lower latching protruding parts 59. In addition, latching ridges 61 extending in the up-down direction protrude from the left and right outer surfaces of the small-diameter part 58. Three small circular protruding parts 62 arrayed in the circumferential direction are formed on the upper-side outer surface of the small-diameter part 58; large circular protruding parts 63 are formed on the lower-side surface of the small-diameter part 58 on both sides of the divided portion, one circular protruding part 63 on each side. A C-shaped ridge 64 protrudes (bulges) from the front surface of the large-diameter part 57 over substantially the entire circumference of the large-diameter part 57.

The outer-side sandwich part 52 of the upper housing 50 has an outer diameter that is substantially the same as the outer diameter of the large-diameter part 57 of the vibration-isolating rubber ring 56, and continuously extends from (connects to) the grip part 9. Exterior latching parts 65, which latch in the upper-side latching protruding parts 59 on the outer side of the vibration-isolating rubber ring 56, are formed on the front-end inner circumference of the outer-side sandwich part 52. Recessed grooves (not shown), into which the upper halves of the latching ridges 61 mate, are formed in the left and right inner surfaces of the outer-side sandwich part 52.

Figure 8:
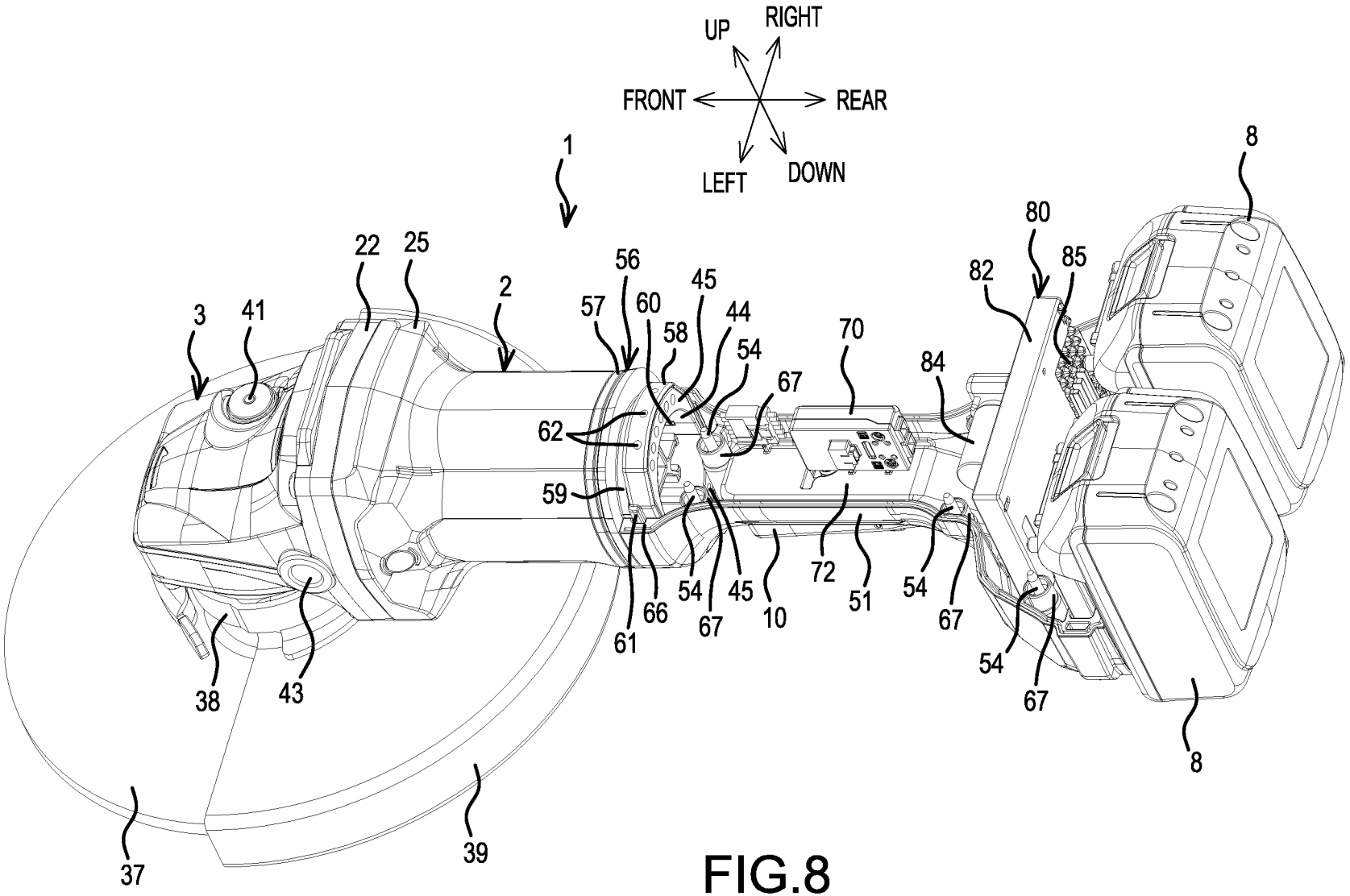
FIG. 8 is an oblique view of the power tool with an upper housing removed.

The outer-side sandwich part 53 of the lower housing 51 likewise has an outer diameter that is substantially the same as the outer diameter of the large-diameter part 57 of the vibration-isolating rubber ring 56 and continuously extends from (connects to) the grip part 9. Left and right exterior latching parts (not shown) that latch in the lower-side latching protruding parts 59 on the outer side of the vibration-isolating rubber ring 56 are formed on the front-end inner circumference of the outer-side sandwich part 53. As shown in FIG. 8, recessed grooves 66, into which the lower halves of the latching ridges 61 mate, are formed in the left and right inner surfaces of the outer-side sandwich part 53.

In the present embodiment, the upper and lower housings 50, 51 are screw-fastened (a) at two locations, on the left and the right, rearward of the outer-side sandwich parts 52, 53, (b) at two locations, on the left and the right, in front of the flared part 7, and (c) at three locations, on the left, the right, and the center, in the flared part 7. Screw-receiving seats (cylindrical recesses) 67, into which the screws 54 are inserted and which are sufficiently deep to receive the screws 54 such the screw heads are submerged below the outer surface of the lower housing 51, are formed at every screw-fastening location of the lower housing 51. Screw bosses 68, which mate with the receiving seats 67 from above and into which the screws 54 are screwed, are formed at every screw-fastening location of the upper housing 50. According to the present embodiment, the screws 54 are inserted on the side of the lower housing 51 and extend into the upper housing 50.

A switch 70 is housed inside the grip housing 4 such that a plunger 71 projects facing downward at substantially the center of the grip part 9. A rear end of the switch lever 10 is pivotably supported, within a mounting recessed part 72 that is recessed in the front-rear direction, on a lower surface of the lower housing 51 and is pivotable up and down between an upper side ON position, in which the switch lever 10 is pressed into the mounting recessed part 72, and a lower side OFF position, which is the opening side of the mounting recessed part 72. A coil spring 73 biases (urges) the switch lever 10 toward the OFF position. A lock-OFF lever 74 is provided in an intermediate portion of the switch lever 10. In the normal state (i.e. when the switch lever 10 is not being pressed/squeezed), the lock-OFF lever 74 is rotationally biased to a vertically oriented attitude such that it opposes a restricting projection 75, which is provided on a bottom part of the mounting recessed part 72. When the lock-OFF lever 74 is manually rotated away from the restricting projection 75 to a transversely oriented attitude, it becomes possible to push in (squeeze) the switch lever 10. This rotational manipulation of the lock-OFF lever 74 can be performed in a simple manner by a finger of the hand that is grasping the grip part 9.

A controller 80 is provided inside the flared part 7. The controller 80 includes a circuit board 81, on which six FETs corresponding to the coils 16 of the brushless motor 5, a microcontroller, and the like are installed, that is housed in a dish-shaped case 82 made of aluminum. The controller 80 is held by a holding wall 83 in a vertically oriented attitude orthogonal to the shaft axis (longitudinal axis) of the grip part 9. The holding wall 83 extends vertically downward from an inner surface of the upper housing 50 and surrounds the rear, left, and right sides of the controller 80. A capacitor 84 is provided at the outer side of the case 82 at the front surface of the controller 80, and a grid-shaped groove 85 is formed in a rear surface of the case 82, as shown in FIG. 8. An air-suction port 86 extending in the left-right direction is formed in the upper housing 50 in a region that communicates with the interior of the holding wall 83. An air-suction-port cover 87 having a mesh stretched within a frame is provided on (attached to) the air-suction port 86.

Each of the battery packs 8 has a connection part 91 that comprises terminals on an upper part of an outer case 90 that houses a plurality of cells. Two rail parts 92 respectively project from the two opposite sides of the connection part 91.

Figure 9:
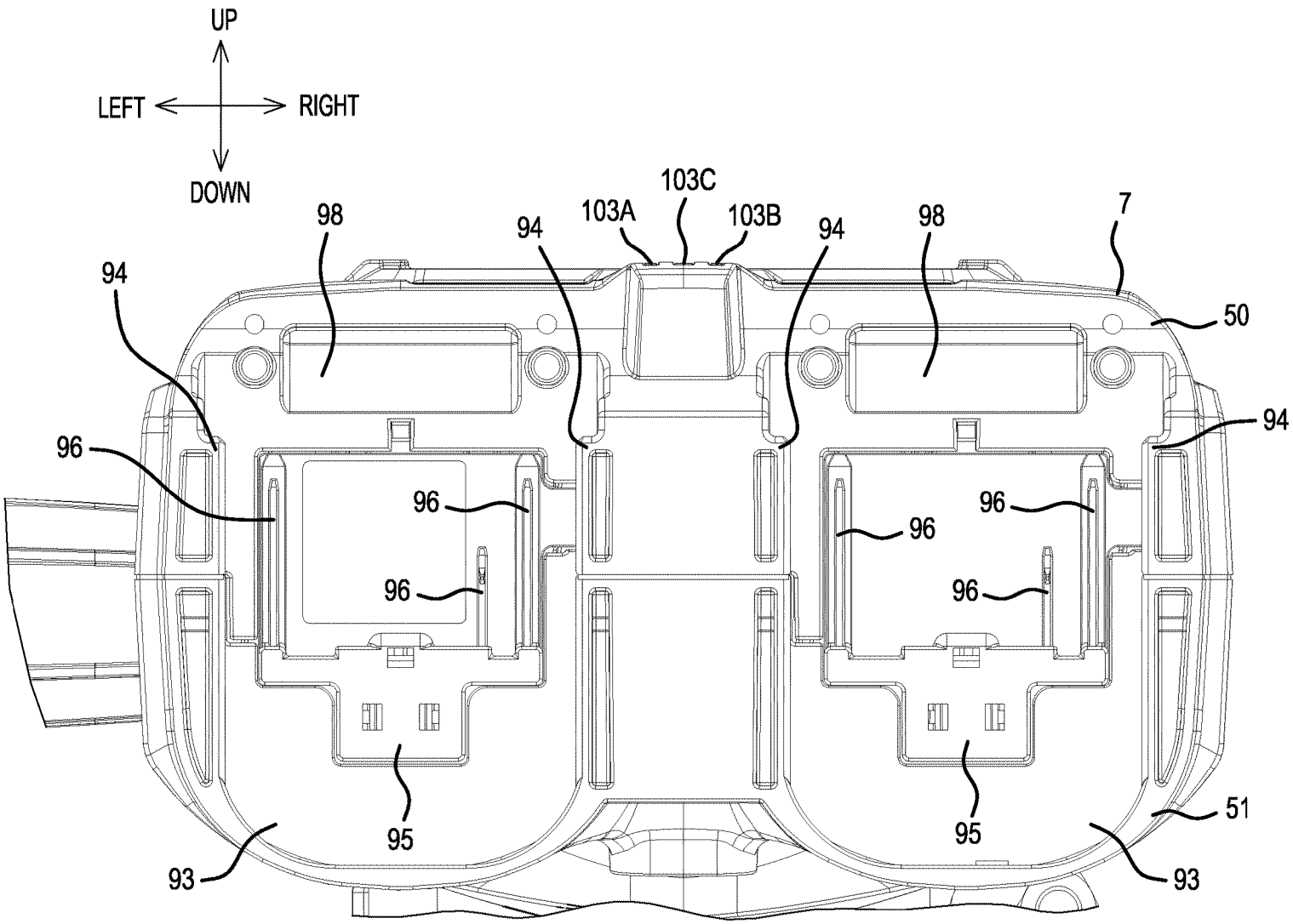
FIG. 9 is an explanatory diagram of battery-mount parts, viewed from the rear.

As shown in FIG. 9, the flared part 7 comprises two battery-mount parts 93, which respectively receive the connection parts 91 of the battery packs 8 from above. Each battery-mount part 93 has two guide rails 94, which mate with the rail parts 92 of the battery pack 8 mounted thereon and protrude from opposite sides of the battery-mount part 93. In addition, in each battery-mount part 93, a terminal block 95 comprising terminal plates 96 that correspond to the terminals of the connection part 91 is provided facing upward between the guide rails 94. The terminal blocks 95 of the two battery-mount parts 93 are sandwiched by an upper-side portion and a lower-side portion of the flared part 7 formed by the upper and lower housings 50, 51, which are divided in the up-down direction.

Thereby, when each of the battery packs 8 is slid from above with the battery-mount part 93 in a vertically oriented attitude such that the connection part 91 faces frontward and the rail parts 92 are engaged with the guide rails 94, the connection part 91 mates with the battery-mount part 93, and the terminals of the connection part 91 electrically connect with the terminal plates 96 of the terminal block 95. In this mounted state, a latching hook 97, which is biased to protrude from the battery pack 8, latches in a latching recess part 98 provided in the battery-mount part 93, and thereby retains the battery pack 8 on the battery-mount part 93.

Figure 4:
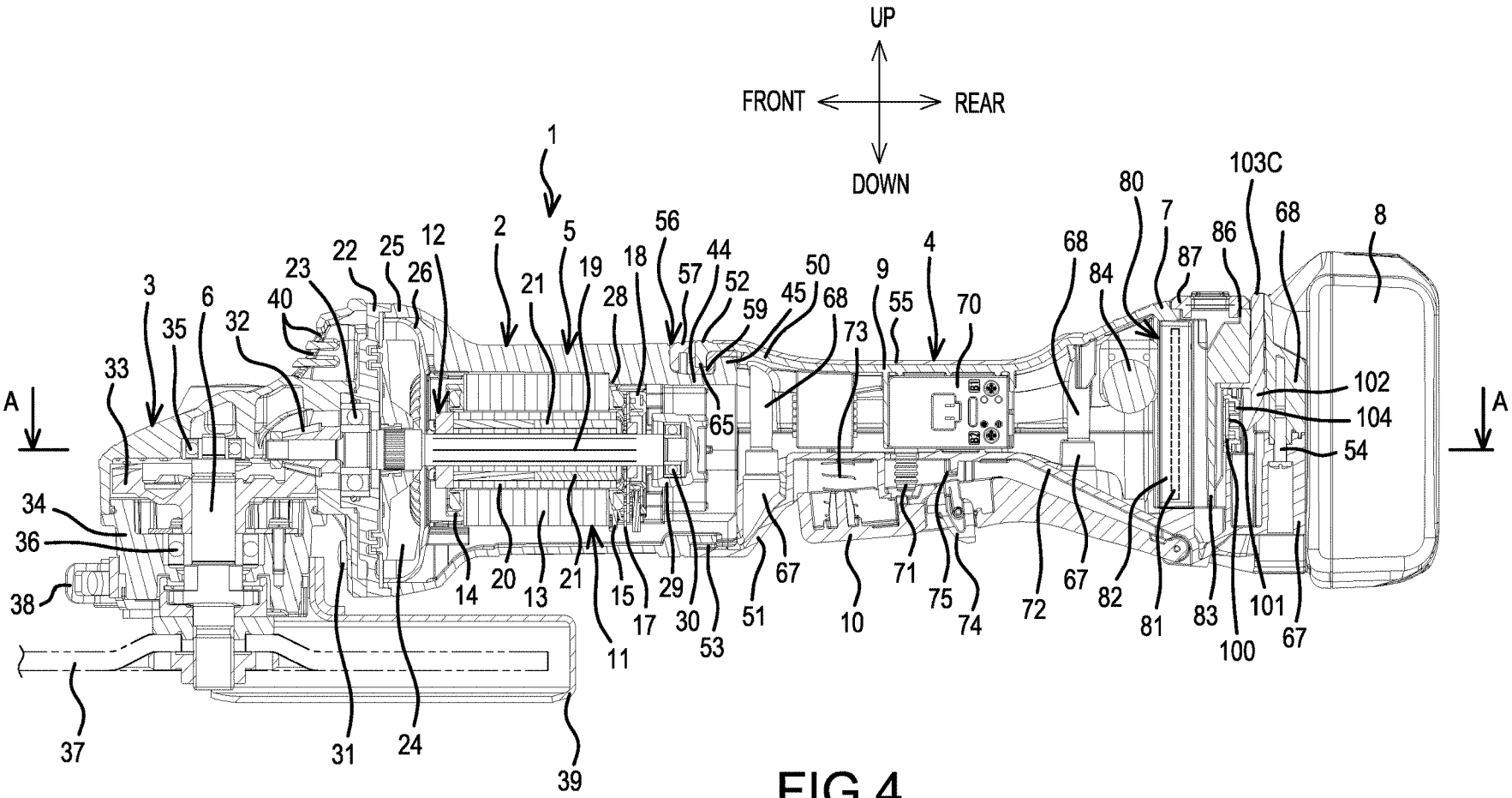
FIG. 4 is a center cross-sectional view of the rechargeable grinder.
Figure 10:
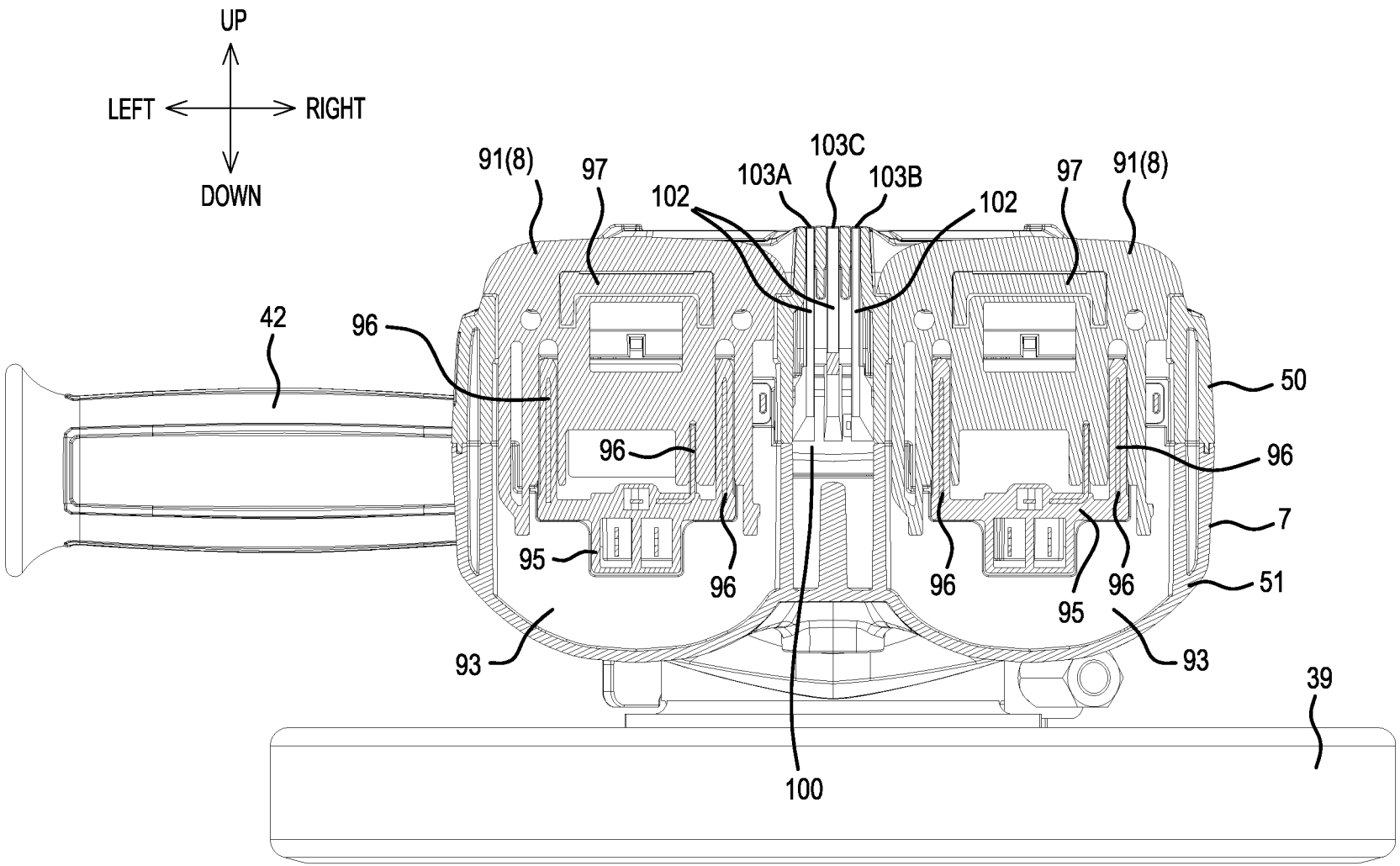
FIG. 10 is a cross-sectional view of the battery-mount parts at a display part portion.

As shown in FIG. 4, an LED board 100, on which three LEDs 101 are aligned in the left-right direction, is held in the upper housing 50, in a vertically oriented attitude with the mounted side of the LEDs 101 facing rearward, on the front side of the screw bosses 68 and rearward of the holding wall 83. In addition, as also shown in FIG. 10, lenses 102, which extend upward and have forward-bent, lower ends corresponding to the LEDs 101, are held rearward of the LED board 100. Upper ends of the lenses 102 are exposed at the upper surface of the flared part 7 rearward of the air-suction-port cover 87. Thereby, the upper ends of the lenses 102 respectively appear as two display lamps 103A, 103B on the left and right aligned in the left-right direction, and a display lamp 103C, which is positioned between the two display lamps 103A, 103B, between the left and right battery packs 8 on the upper surface of the flared part 7. A holder 104 holds the LED board 100 inside the flared part 7.

In the present embodiment, the center display lamp 103C indicates an automatic speed-changing state, in which the speed is automatically changed by an electronic gear controlled by the controller 80, and therefore it lights with a blue color during automatic speed changing. The display lamps 103A, 103B on both sides thereof indicate that the controller 80 has detected an overcurrent, an excessive temperature rise, a zero-remaining charge state or the like of one of the battery packs 8, and has stopped (automatically stopped) the supply of power from the corresponding battery pack 8. In the present embodiment, if an overcurrent or an excessive temperature rise has occurred, then the display lamps 103A, 103B on both sides flash ON and OFF with a red color; if either of the battery packs 8 is discharged below a predetermined threshold, then the display lamp 103A, 103B on the corresponding side is lit with a red color to indicate that the depleted battery pack 8 requires recharging.

Thus, by disposing the display lamps 103A, 103B, which are for automatic-stop alerts, on both sides of the display lamp 103C such that they sandwich the display lamp 103C, which is for automatic speed changing, it becomes easier to discriminate and visually confirm the left and right display lamps 103A, 103B. In addition, because the display lamps 103A-103C are formed using the LEDs 101 and the lenses 102, the display lamps 103A-103C can be formed even at locations spaced apart from the LED board 100, which increases the number of degrees of freedom in the layout.

Figure 2:
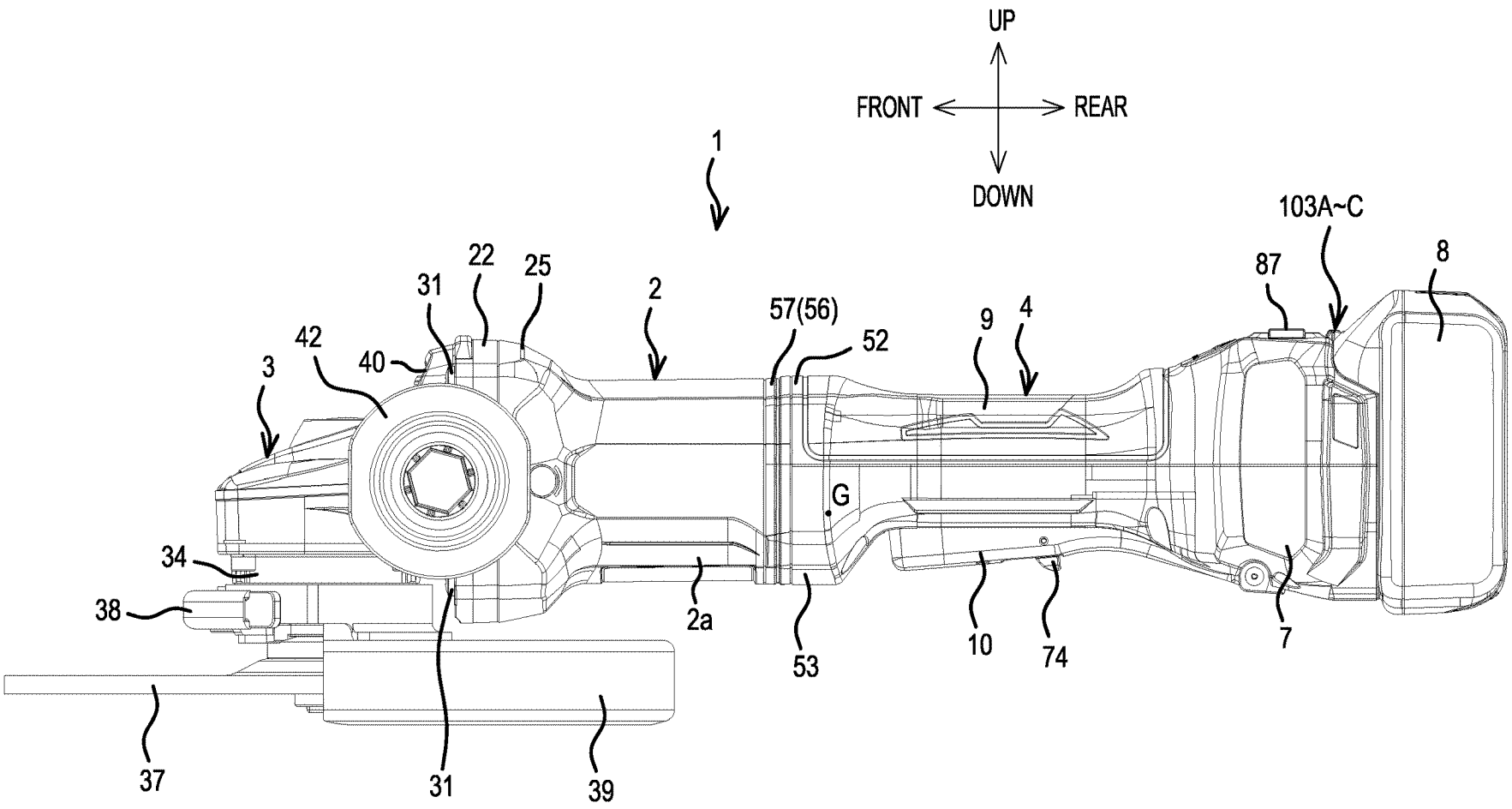
FIG. 2 is a side view of the rechargeable grinder.
Figure 3:
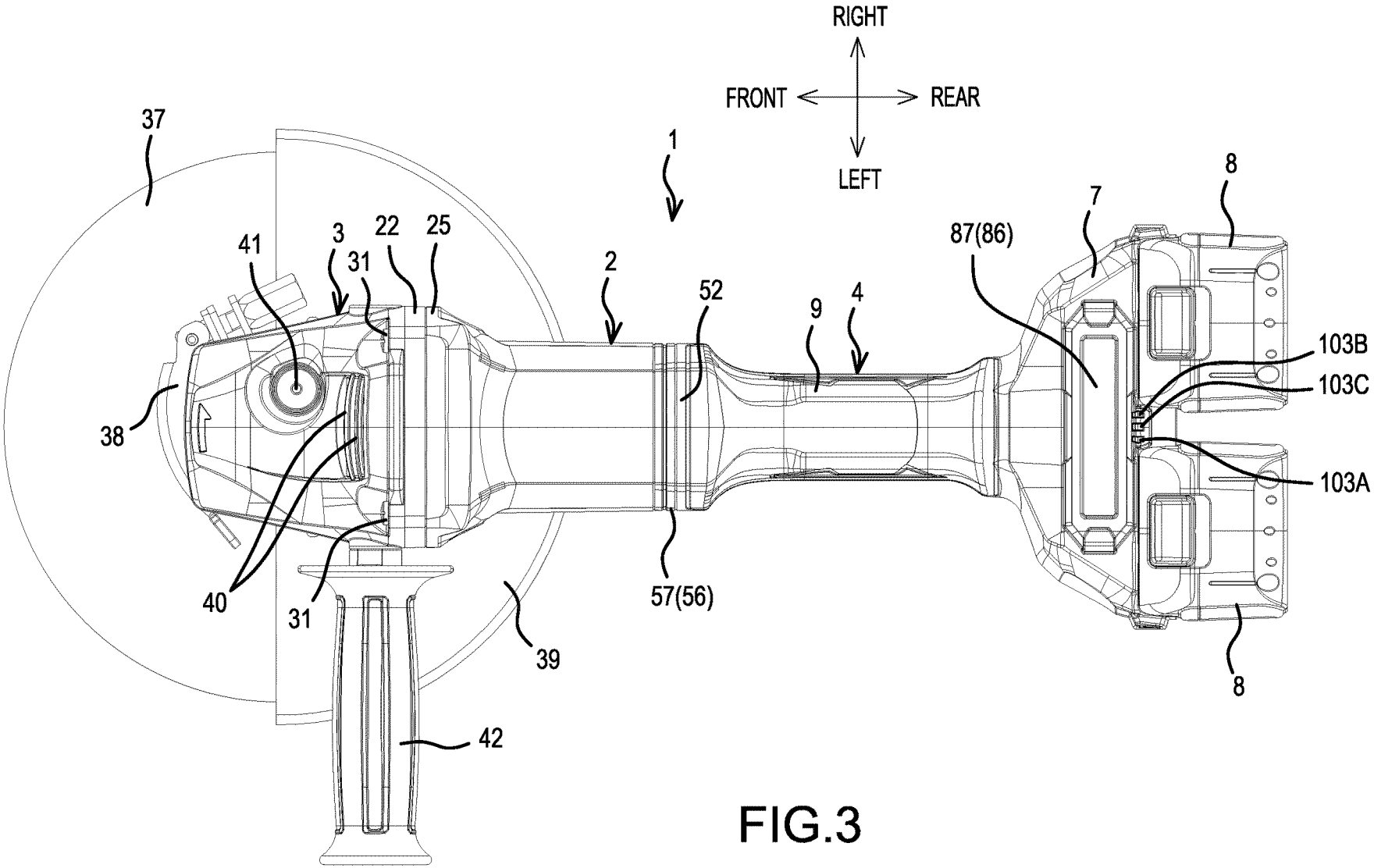
FIG. 3 is a plan view of the rechargeable grinder.

Turning now to the weight balance (center of gravity) of the grinder 1, because the diameter of the tool accessory 37 is large, e.g., 180 mm or greater, the center of gravity G of the entire grinder 1 in the state in which the two battery packs 8 are mounted is preferably set, as shown in FIG. 2, to a location on the side of the grip housing 4 that is spaced apart by a prescribed distance (e.g., 15 mm) frontward of the front end of the switch lever 10.

The grinder 1 is manipulated by grasping the grip part 9 using one's dominant hand and grasping the side handle 42 using the other hand. If the center of gravity were to instead be on the side of the motor housing 2, then the arm that performs the majority of the work will tire over a long period of time and tend to wander when performing upward-facing work, thereby making it difficult to maintain the tool accessory 37 in contact with the workpiece.

However, because the center of gravity G of the present embodiment is set to a location near the dominant hand grasping the grip part 9, even if upward-facing work is performed or work is performed with an unstable stance, stable handling characteristics can be ensured and satisfactory ease of operation can be obtained with little stress on the arm.

Figure 11:
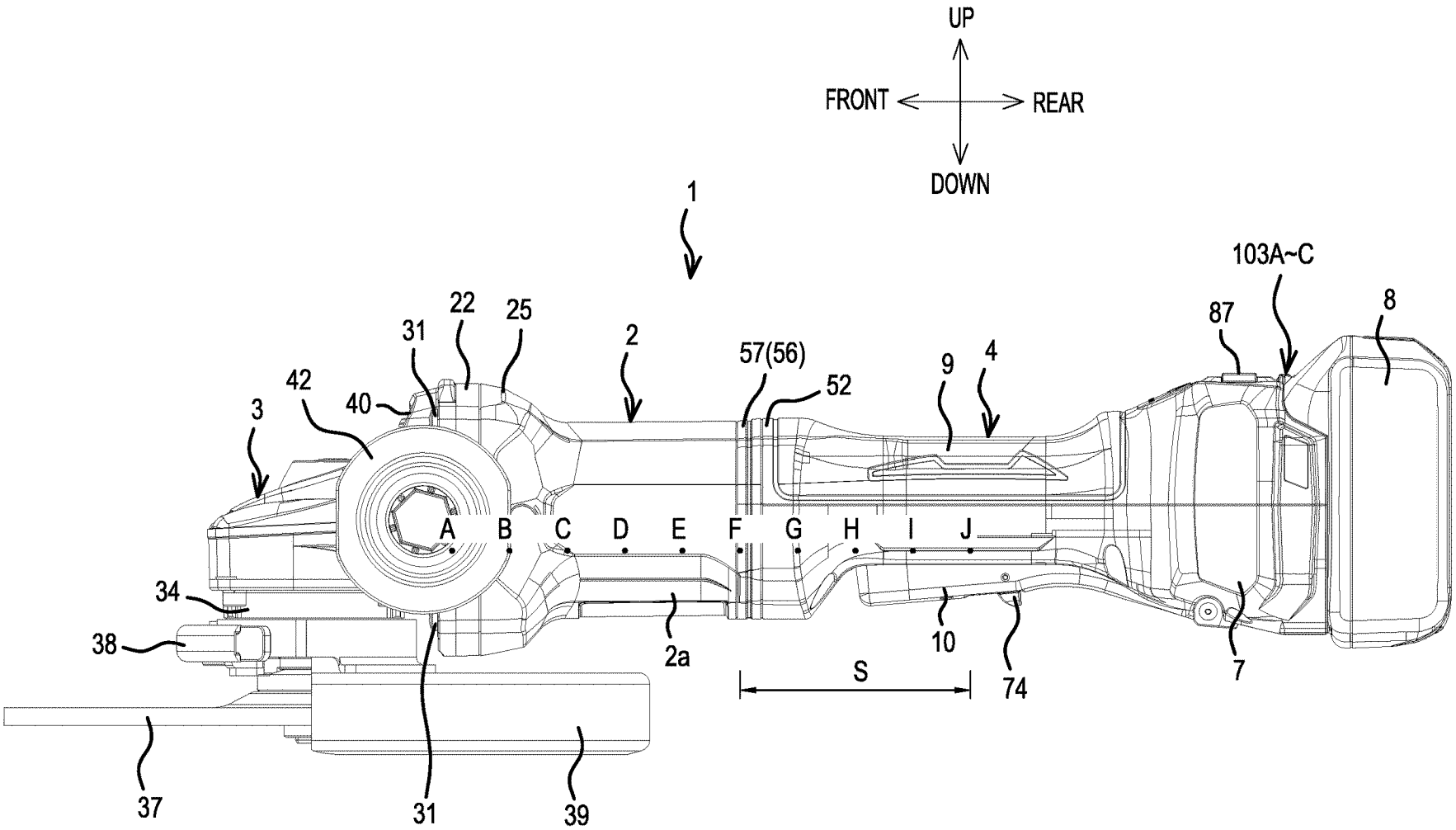
FIG. 11 is an explanatory diagram that shows the positions of the center of gravity for ten (A-J) test samples.

This was verified by setting the center of gravity to the locations A-J, as shown in FIG. 11, at intervals of 15 mm in ten test devices, and evaluating the handling characteristics (i.e., whether the stress to the arm was low and it felt easy to handle) while work was performed with the ten test devices having the different centers of gravity A-J. As a result of this evaluation, it was confirmed that the handling characteristics were most satisfactory at the positions of the centers of gravity G and H.

Accordingly, although the overall center of gravity may be the center of gravity H shown in FIG. 11 (the same location in the up-down direction as the front end of the switch lever 10), if grasping the grip part 9 rearward thereof is contemplated, then the overall center of gravity of the grinder 1 is preferably set within a range of 30 mm forward of the front end of the switch lever 10 to 30 mm rearward of the front end of the switch lever 10 (i.e. region S shown in FIG. 11). If the center of gravity is set within this range, because the center of gravity will be located within the grip housing 4 towards the front side of the grip housing 4, the result can be expected that the grinder 1 tends not to wander and the arm of the dominant hand also tends not to tire during work.

It is noted that, here, considering ease of graspability while the grinder 1 is being carried, hollow parts 2*a*, which serve as fingertip-grasping parts, are formed in the front-rear direction on a lower-surface side of the motor housing 2 on both the left and right sides.

In the grinder 1 configured as above, the grip housing 4 may be assembled onto the motor housing 2 in the following manner. First, the vibration-isolating rubber ring 56 is disposed around (pushed onto) the interior ring part 44 of the motor housing 2 with the large-diameter part 57 is set toward the front side. As a result, the latching protruding parts 59 latch onto the front side of the stops 45, and the projections 60 are inserted into the through holes 46 of the interior ring part 44.

Then, the upper housing 50 is assembled (mounted) on the motor housing 2 by latching the exterior latching parts 65 of the outer-side sandwich part 52 in the latching protruding parts 59 of the vibration-isolating rubber ring 56 (i.e. from the outer side of the vibration-isolating rubber ring 56), and mating the recessed grooves with the latching ridges 61. Thereafter, the motor housing 2 and upper housing 50 (which is now attached to the motor housing 2) are turned upside-down, the switch 70, the controller 80, the LED board 100, the terminal blocks 95, etc., are inserted into the upper housing 50 (which is actually upside-down at this time) and the wiring within the upper housing 50 is performed.

Separately, the switch lever 10 is turned upside-down and is then installed in the lower housing 51. The lower housing 51 is then assembled (mounted) on the upside-down upper housing 50 (which is already connected to the motor housing 2) by latching the left and right exterior latching parts of the outer-side sandwich part 53 in the latching protruding parts 59 of the vibration-isolating rubber ring 56 (from the upper side of the upside-down upper housing 50), and by mating the recessed grooves 66 with the latching ridges 61. In this state, the screws 54 are inserted from above into the receiving seats 67 of the lower housing 51 (which is located above the upside-down upper housing) and then screwed fully into the screw bosses 68 of the upper housing 50. In this manner, the upper and lower housings 50, 51 are joined to form the grip housing 4, which is connected to the motor housing 2.

In this connected state of the grip housing 4, the exterior latching parts 65 of the outer-side sandwich parts 52, 53 are latched onto, retained by, and rotationally locked by the stops 45 of the interior ring part 44 via the vibration-isolating rubber ring 56. In addition, the upper and lower recessed grooves 66 are also rotationally locked by being latched onto the latching ridges 61. Furthermore, because the large-diameter part 57 of the vibration-isolating rubber ring 56 is interposed between the front end of the grip housing 4 and the motor housing 2, the connection of the two housings 2, 4 is sealed and thereby the ingress of water or the like into the interior of the motor housing 2 and grip housing 4 can be prevented. In particular, because the C-shaped ridge 64 on the front surface of the large-diameter part 57 is in pressure contact with a rear surface of the motor housing 2, excellent sealing properties are obtained. Furthermore, in this connected state, because the inner surface of the grip housing 4 presses the small-diameter part 58 of the vibration-isolating rubber ring 56 onto the interior ring part 44 when the upper and lower circular protruding parts 62, 63 are squeezed, excellent sealing properties are achieved here as well. In addition, because the switch 70 and the controller 80 are held by the single upper housing 50 (i.e. composed of one integral body), forces applied to the grip part 9 in the left-right direction can be better counteracted. Therefore, compared with an embodiment in which the switch 70 and the controller 80 are held by left-right housing halves, which are divided in the left-right direction (i.e. the seam therebetween is in a plane containing the up-down direction), the risk that the switch 70, the controller 80, or the like will tilt, rattle, etc. inside the grip housing 4 is reduced.

During use of the grinder 1, when the switch lever 10 is depressed in the state in which the lock-OFF lever 74 has been rotated and the press-in control has been released as was described above, the switch 70 is turned ON, and the circuit board 81 of the controller 80, which receives power from the battery packs 8, supplies three-phase current to the brushless motor 5, thereby driving the brushless motor 5. That is, the microcontroller of the circuit board 81 acquires the rotational state of the rotor 12 by obtaining the rotation-detection signals, which indicate the positions of the permanent magnets 21 of the rotor 12 output from the rotation-detection devices of the sensor circuit board 17, and controls the ON/OFF state of each of the FETs in accordance with the acquired rotational state; thereby, the rotor 12 is rotated by sequentially supplying electric current to each of the coils 16 of the stator 11. Because the rotary shaft 19 rotates and the spindle 6 is rotated via the bevel gears 32, 33, it becomes possible for the rotating tool accessory 37 to perform grinding work, etc.

Because the vibration-isolating rubber ring 56 is interposed between the motor housing 2 and the grip housing 4, vibration produced at the forward side of the motor housing 2 during operation is dampened by the vibration-isolating rubber ring 56, thereby suppressing the transmission of vibration to the grip housing 4. Thereby, vibration tends not to propagate to the hand that grasps the grip part 9. In addition, because the transmission of vibration to the switch 70, the controller 80, and the like is likewise suppressed, the durability (service life) of these electrical components is also improved.

In addition, when the centrifugal fan 24 rotates as the rotary shaft 19 rotates, outside air is sucked in from the rearward air-suction port 86, passes along the rear surface of the case 82 of the controller 80 while descending downward, flows from the left and right on the lower side of the controller 80 and then flows around toward the front and into the grip housing 4. Furthermore, the air passes along the switch 70, reaches the interior of the motor housing 2, passes between the stator 11 and the rotor 12 of the brushless motor 5, is delivered into the gear housing 3, and is then discharged to the exterior via the air-exhaust ports 40. The controller 80, as well as the brushless motor 5, are cooled by the flow of this air.

In the present embodiment, because the display lamps 103A-103C are located rearward of the air-suction port 86 (on the opposite side of the airflow), the display lamps 103A-103C tend not to become dirty.

Furthermore, if the remaining charge of either one of the battery packs 8 falls below a predetermined threshold, resulting in the power stopped state, then the controller 80 turns ON the LED 101 on the corresponding side using the LED board 100, and turns ON the display lamp 103A or the display lamp 103B via the corresponding lens 102. From this illuminated indication, the user knows that the remaining charge of the battery pack 8 on the side that is turned ON (illuminated) is insufficient for further operation and the user can remove and charge the depleted battery pack 8, replace it with a new battery pack, etc. If an overcurrent, an excessive temperature rise, or the like occurs, then the controller 80 flashes ON and OFF the LEDs 101, 101 on both the left and right sides, and thereby flashes ON and OFF the display lamps 103A, 103B via the left and right lenses 102, 102.

Thus, the grinder 1 above includes: the brushless motor 5; the battery-mount parts 93, on which the battery packs 8 for driving the brushless motor 5 can be mounted; the controller 80, which stops the supply of power from the battery packs 8 to the brushless motor 5 when the remaining charge of the battery packs 8 has decreased below a predetermined level; and the display parts (the display lamps 103A, 103B), which display the fact that the supply of power from the battery packs 8 to the brushless motor 5 has been stopped. Consequently, the timing of charging, replacement, or the like of the battery packs 8 can be reliably alerted. In addition, because these are only for indicating the power supply stoppage, they can be configured in a space-saving manner and the display parts (the display lamps 103A, 103B) can be disposed near their corresponding battery packs 8, 8.

In particular, the above-described embodiment includes the two battery-mount parts 93 on which the two battery packs 8 can be mounted. By providing the display lamp 103A and the display lamp 103B, which individually display the fact that the controller 80 has stopped the supply of power from the two battery packs 8 to the brushless motor 5, even when two of the battery packs 8, 8 are mounted, it is possible to visually confirm in a reliable manner the power supply of which one has been stopped.

In addition, because the two battery-mount parts 93, 93 are disposed such that they are side-by-side in the left-right direction and the display lamps 103A, 103B are provided such that they are side-by-side in the left-right direction between the two battery packs 8, 8, which are mounted on the two battery-mount parts 93, 93, the correspondence relationship between the battery packs 8, 8 and the display lamps 103A, 103B can be easily perceived.

Furthermore, because the display lamps 103A, 103B are provided on the upper surface of the flared part 7, which has the battery-mount parts 93, the display lamps 103A, 103B become easy to visually confirm.

It is noted that, with regard to the display parts, the display lamp for automatic speed changing is not essential; if an electronic-gear function is not provided, then it is possible to provide only the display lamps for alerting an automatic stop on the left and right.

In addition, the lenses may be omitted in some embodiments of the present teachings. For example, if space is available, the LED board may be disposed on the rear side of the upper surface of the flared part, and the LEDs may be made visible directly from (at, on) the upper surface.

Furthermore, the positions of the display parts are not limited to the positions according to the embodiment described above. For example, if there is no air-suction port, then the display parts may be disposed more forwardly; or if there is adequate space between the battery packs, the display parts may be disposed more rearwardly.

Furthermore, the grinder 1 of the embodiment includes: the motor housing 2, which houses the brushless motor 5; the grip housing 4, which is coupled to the motor housing 2 in the front-rear direction and has the grip part 9; and the battery-mount parts 93, which are formed on the grip housing 4 and on which the battery packs 8 can be mounted. Because the grip housing 4 is formed by assembling (joining) the upper and lower housings (housing halves) 50, 51, which are divided into 2 in the up-down direction (i.e. the seam therebetween is in a plane containing the left-right direction), it is possible to arrange the two battery-mount parts 93 side-by-side in the left-right direction while also simplifying assembly and without complicating the shape of the grip housing 4.

In particular, because the upper and lower housings 50, 51 are assembled (joined) by screwing the screws 54 from the lower housing 51 into the upper housing 50 in the above-described embodiment, the upper and lower housings 50, 51 can be assembled (joined) easily.

In addition, because the switch 70 is housed inside the grip housing 4, and the switch lever 10 for manipulating (turning, pressing) the switch 70 ON and OFF is provided on the lower housing 51, the switch lever 10 can be easily assembled in the lower housing 51, which becomes the upper side at the time of assembly.

Furthermore, because the controller 80 is housed inside the grip housing 4 and the holding wall 83 that holds the controller 80 is provided in the upper housing 50, the controller 80 can be easily assembled in the upper housing 50, which becomes the lower side at the time of assembly.

It is noted that, with regard to the housing halves of the grip housing 4, which are divided into 2 in the up-down direction, although the location of the split (seam) in the above-described embodiment is upward of the axis line (rotational axis) of the rotary shaft of the motor, the location of the split may be set in the same plane with the axis line.

In addition, the positions of the air-suction port and the air-suction-port cover may be vertically reversed or may be on a side surface. The air-suction-port cover may be eliminated and instead multiple air-suction ports having small opening areas may be formed.

In addition, common to each of the above-noted aspects of the present teachings, the motor may be a commutator motor or the like, and the power tool is not limited to being a grinder; for example, the present invention can also be applied to other power tools such as a sander, a circular saw, or the like.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings to provide improved power tools.

Moreover, combinations of features and steps disclosed in the above detailed description, as well as in the below additional examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Rechargeable grinder
2 Motor housing
3 Gear housing
4 Grip housing
5 Brushless motor
6 Spindle
7 Flared part
8 Battery pack
9 Grip part
10 Switch lever
11 Stator
12 Rotor
19 Rotary shaft
24 Centrifugal fan
37 Tool accessory
40 Air-exhaust port
44 Interior ring part
50 Upper housing
51 Lower housing
56 Vibration-isolating rubber ring ring
70 Switch
80 Controller
81 Circuit board
82 Case
83 Holding wall (holding part)
93 Battery-mount part
100 LED board

101 LED
102 Lens
103A Display lamp (first display part)
103B Display lamp (second display part)

The invention claimed is:

1. A power tool, comprising:

a motor housing that houses a motor; and a grip housing extending in a longitudinal direction of the power tool and having a first longitudinal end coupled to the motor housing, first and second battery-mount parts formed at a second longitudinal end, and a grip part disposed between the first and second longitudinal ends;

wherein:

first and second battery packs are respectively mountable on the first and second battery-mount parts;

the grip housing comprises an upper housing half joined to a lower housing half, an upper portion of the first battery-mount part and an upper portion of the second battery-mount part are formed on the upper housing half, and a lower portion of the first battery-mount part and a lower portion of the second battery-mount part are formed on the lower housing half.

2. The power tool according to claim 1, wherein the upper housing half is joined to the lower housing half by one or more screws extending in an up-down direction of the power tool.

3. The power tool according to claim 2, further comprising:

a switch for driving the motor, the switch being housed inside the grip housing, and a switch lever for manipulating the switch ON and OFF, the switch lever being provided on one of the first and second housing halves.

4. The power tool according to claim 3, further comprising:

a controller for controlling the motor, the controller being housed inside the grip housing, and a holding part that holds the controller and is provided in the other one of the first and second housing halves.

5. The power tool according to claim 1, wherein the power tool includes a rotatable spindle operably connected to the motor and extending in an up-down direction.

6. The power tool according to claim 1, including a first battery mounted on the first battery-mount part and a second battery mounted on the second battery-mount part, wherein:

the upper housing half is joined to the lower housing half at a seam; and the first and second batteries each overlie an end portion of the seam.

7. A power tool, comprising:

a motor;

a head part disposed on a front side of the motor;

a grip part disposed on a rear side of the motor and comprising a switch lever; and a first battery-mount part disposed on a rear side of the grip part, a first battery pack being mountable on the first battery-mount part;

wherein, when the battery pack is mounted on the battery-mount part, the overall center of gravity of the power tool is located within a range from 30 mm forward of a front end of the switch lever to 30 mm rearward of the front end of the switch lever.

8. The power tool according to claim 7, wherein the overall center of gravity of the power tool is located at a position that is intersected by a line that extends in an up-down direction of the power tool and intersects the front end of the switch lever.

9. The power tool according to claim 7, further comprising:

a second battery-mount part disposed on the rear side of the grip part, a second battery pack being mountable on the second battery-mount part, wherein when the first and second battery packs are mounted on the first and second battery-mount parts, the overall center of gravity of the power tool is located 15 mm forward of the front end of the switch lever.

10. A power tool, comprising:

a motor having a motor shaft that extends in a longitudinal direction of the power tool;

a spindle operably driven by the motor shaft and extending perpendicular to the motor shaft in an up-down direction of the power tool;

a motor housing that houses the motor; and a grip housing extending in the longitudinal direction of the power tool and having a first longitudinal end coupled to the motor housing, first and second battery-mount parts formed at a second longitudinal end, and a grip part disposed between the first and second longitudinal ends;

wherein first and second battery packs are respectively mountable on the first and second battery-mount parts, the grip housing comprises an upper housing half joined to a lower housing half, a seam between the upper housing half and the lower housing half at least substantially extends along a plane that contains, or is parallel to, the longitudinal direction and is perpendicular to the up-down direction, and the seam intersects a substantially central portion of both of the first and second battery-mount parts in the up-down direction of the power tool.

11. The power tool according to claim 10, wherein the upper housing half is joined to the lower housing half by one or more screws that extend in the up-down direction of the power tool.

12. The power tool according to claim 10, further comprising:

a switch disposed inside the grip housing and being electrically connected to the motor to turn the motor ON and OFF; and a switch lever pivotably coupled to the lower housing half, the switch lever being configured to turn the switch ON and OFF when manually squeezed and released, respectively, by a user.

13. The power tool according to claim 10, further comprising:

a controller disposed inside the grip housing and being electrically connected to the motor, and a controller holder attached to an interior surface of the upper housing half and holding the controller.

14. The power tool according to claim 13, further comprising:

a switch disposed inside the grip housing and being electrically connected to the motor to turn the motor ON and OFF; and a switch lever pivotably coupled to the lower housing half, the switch lever being configured to turn the switch ON and OFF when manually squeezed and released, respectively, by a user.

15. The power tool according to claim 14, wherein the upper housing half is joined to the lower housing half by one or more screws that extend in the up-down direction of the power tool.

16. The power tool according to claim 15, further comprising a grinding disk attached to the spindle.

17. The power tool according to claim 16, wherein the controller is substantially planar and the controller at least substantially lies in a plane containing the up-down direction.

18. The power tool according to claim 17, wherein the first and second battery-mount parts each comprise guide rails that extend in the up-down direction and engage complementary rails provided on the first and second battery packs, respectively.

19. The power tool according to claim 18, further comprising a display provided on an upper surface of a flared part of the grip housing, the flared part being disposed between the grip part and the first and second battery-mount parts in the longitudinal direction of the power tool.

20. The power tool according to claim 19, further comprising an air suction port disposed on the upper surface of the flared part, the air suction port being in fluid communication with an interior of the controller holder such that air drawn in through the air suction port flows across the controller before being directed towards the switch and motor.

* * * * *